US008278545B2

(12) United States Patent
Hamanaka

(10) Patent No.: US 8,278,545 B2
(45) Date of Patent: Oct. 2, 2012

(54) MORPHED MUSICAL PIECE GENERATION SYSTEM AND MORPHED MUSICAL PIECE GENERATION PROGRAM

(75) Inventor: Masatoshi Hamanaka, Tsukuba (JP)

(73) Assignee: Japan Science and Technology Agency, Kawaguchi-shi (JP)

( * ) Notice: Subject to any disclaimer, the term of this patent is extended or adjusted under 35 U.S.C. 154(b) by 276 days.

(21) Appl. No.: 12/866,146

(22) PCT Filed: Feb. 4, 2009

(86) PCT No.: PCT/JP2009/051889

§ 371 (c)(1),
(2), (4) Date: Aug. 4, 2010

(87) PCT Pub. No.: WO2009/099103

PCT Pub. Date: Aug. 13, 2009

(65) Prior Publication Data

US 2010/0325163 A1 Dec. 23, 2010

(30) Foreign Application Priority Data

Feb. 5, 2008 (JP) ..... 2008-025374

(51) Int. Cl.
*G10H 1/36* (2006.01)

(52) U.S. Cl. ..... 84/610; 84/609; 84/622; 84/649; 84/650; 84/659

(58) Field of Classification Search ..... None
See application file for complete search history.

(56) References Cited

U.S. PATENT DOCUMENTS 5,663,517 A * 9/1997 Oppenheim ..... 84/649
6,051,770 A * 4/2000 Milburn et al. ..... 84/611
6,506,969 B1 * 1/2003 Baron ..... 84/609
2001/0039870 A1 * 11/2001 Shimaya et al. ..... 84/478

FOREIGN PATENT DOCUMENTS

JP 2004-233573 8/2004
JP 2007-101780 4/2007
JP 2007-241026 9/2007

(Continued)

OTHER PUBLICATIONS

Tempei, Sato; "Computer Music Super Beginner's Manual", Softbank Creative Corporation, 1997.

(Continued)

*Primary Examiner* — Marlo Fletcher
(74) *Attorney, Agent, or Firm* — Rankin, Hill & Clark LLP

(57) ABSTRACT

A morphed musical piece generation system that enables even a user with little knowledge of music to easily generate a morphed musical piece between two different musical pieces is provided. A first intermediate time-span tree data generation section 6 selectively removes difference information between common time-span tree data and first time-span tree data from the first time-span tree data.

Also, a second intermediate time-span tree data generation section 7 performs the same operation to obtain second intermediate time-span tree data. A data combining section combines the first intermediate time-span tree data and the second intermediate time-span tree data to generate combined time-span tree data. A musical piece data generation section generates a morphed musical piece on the basis of the combined time-span tree data.

20 Claims, 10 Drawing Sheets

FOREIGN PATENT DOCUMENTS

WO 2006006901 1/2006

OTHER PUBLICATIONS http://www.apple.com/jp/ilife/garageband; "Learn to Play Music and Record on your Mac".

Hirata and Tojo; "Formalization of Media Design Operations Using Relative Pseudo-Complement", 19th Annual Conference of Japanese Society for Artificial Intelligence, 2B3-08, 2005.

Lerdahl and Jackendoff; "A Generative Theory of Tonal Music", Cambridge, MA: MIT Press, 1983.

Hamanaka, et al.; "Implementing a Generative Theory of Tonal Music", Journal of New Music Research; vol. 35, No. 4, pp. 249-277, 2006.

Hamanaka, et al; "Fatta: Full Automatic Time-Span Tree Analyzer", Proceeding of the 2007 International Computer Music Conference, vol. 1, pp. 153-156, 2007.

Hamanaka et al; "Grouping Structure Generator Based on Music Theory GTTM", Journal of Information Processing Society of Japan, vol. 48, No. 1, pp. 284-299, 2007.

Hamanaka et al.; "Full Automation of Time-Span Tree Analyzer", SIGMUS 71, Aug. 2007.

Hirata and Aoyagi; "Representation Method and Primitive Operations for a Polyphony Based on Music Theory GTTM", Journal of Information Processing Society of Japan, vol. 43, No. 2, Feb. 2002.

Hirata and Hiraga; "Revisiting Music Representation Method Based on GTTM", Information Processing Society of Japan SIG Notes, 2002-MUS-45, pp. 1-7, 2002.

Hirata and Tojo; "Lattice for Musical Structure and its Arithmetics", The 20th Annual Conference of the Japanese Society for Artificial Intelligence, 1D2-4, 2006.

Hamanaka , et al; "Time Span Ki ni Motozuku Melody Morphing-ho", Information Processing Society of Japan Kenkyu Hokoku, vol. 2008, No. 12, Feb. 9, 2008, pp. 107 to 112.

Muto et al; "Ongaku no Yoso Kosei Kozo ni Chakumoku shita Kyoku Danpen no Morphing", Information Processing Society of Japan Kenkyu Hokoku, vol. 2001, No. 16, Feb. 22, 2001, pp. 27 to 34.

* cited by examiner

MORPHED MUSICAL PIECE GENERATION SYSTEM AND MORPHED MUSICAL PIECE GENERATION PROGRAM

TECHNICAL FIELD

The present invention relates to a morphed musical piece generation system and a morphed musical piece generation program that generate a morphed musical piece between two different musical pieces.

BACKGROUND ART

Because a medium called music is recognized and expressed in a vague way, it is generally difficult for a user with little knowledge of music to cause a computer to compose or perform a musical piece as he/she desires. In order to realize a musical system that can be manipulated by a user with little knowledge of music, two things are important: (1) how to manipulate music, and (2) how to reflect a user's intention in the music. One thing to note is that increasing the abstraction level of an object to be operated makes it easier to manipulate music but may make it more difficult to reflect a user's intention in the music.

For example, musical score editors and sequencers (Non-Patent Document 1) are commercially available. However, such editors and sequencers can manipulate only surface structures of music with low vagueness, such as notes, rests, and chord names. Meanwhile, Non-Patent Document 2 (http://www.apple.com/jp/ilife/garageband/) discloses a system that allows composing a musical piece just by simple operations, such as combining some of a large number of loop materials prepared in advance by the system.

Non-Patent Document 3 proposes a technique for morphing two contents using a relative pseudo-complement.

[Non-Patent Document 1] Tenpei Sato, "Computer Music Super Beginners' Manual", Softbank Creative Corporation, 1997

[Non-Patent Document 2] http://www.apple.com/jp/ilife/garageband/

[Non-Patent Document 3] Keiji Hirata and Satoshi Tojo, "Formalization of Media Design Operations Using Relative Pseudo-Complement", 19th Annual Conference of Japanese Society for Artificial Intelligence, 2B3-08, 2005

DISCLOSURE OF INVENTION

Problem to be Solved by the Invention

With the commercially available sequencers according to Non-Patent Document 1, it is difficult for a user with little knowledge of music to appropriately handle the structures. In the case where it is desired to partly modify a melody of a musical piece created using the system according to Non-Patent Document 2, it is necessary to manually manipulate surface structures of music such as notes and rests. Therefore, even with this system, it is difficult for a user with little knowledge of music to reflect his/her intention in the music. Further, in order to use the technique taught in Non-Patent Document 3, it is necessary to calculate a relative pseudo-complement. However, no method for efficiently calculating a relative pseudo-complement has been revealed, and thus the technique according to Non-Patent Document 3 has not been put into practical use yet.

An object of the present invention is to provide a morphed musical piece generation system and a morphed musical piece generation program that enable even a user with little knowledge of music to easily generate a morphed musical piece between two different musical pieces.

Another object of the present invention is to provide a morphed musical piece generation system and a morphed musical piece generation program that assist a user with little knowledge of music in appropriately manipulating deeper structures of music, such as melody, rhythm, and harmony, to generate a morphed musical piece.

Means for Solving the Problems

The present invention provides a morphed musical piece generation system that generates a morphed musical piece between a first musical piece and a second musical piece. The term "morphed musical piece" as used herein means a musical piece containing some of the features of the first musical piece and some of the features of the second musical piece. There are a large number of morphed musical pieces, which range from a musical piece with a strong influence of the features of the first musical piece to a musical piece with a strong influence of the features of the second musical piece. The musical pieces are composed of melodies that do not contain singing voices.

The morphed musical piece generation system according to the present invention includes a common time-span tree data generation section, a first intermediate time-span tree data generation section, a second intermediate time-span tree data generation section, a data combining section, and a musical piece data generation section. The common time-span tree data generation section generates, on the basis of first time-span tree data on a first time-span tree obtained by analyzing first musical piece data on the first musical piece and second time-span tree data on a second time-span tree obtained by analyzing second musical piece data on the second musical piece, common time-span tree data on a common time-span tree obtained by extracting common information between the first time-span tree and the second time-span tree.

The first intermediate time-span tree data generation section generates, on the basis of the first time-span tree data and the common time-span tree data, first intermediate time-span tree data on a first intermediate time-span tree generated by selectively removing one or more pieces of difference information between the first time-span tree and the common time-span tree from the first time-span tree or selectively adding the one or more pieces of difference information to the common time-span tree. Likewise, the second intermediate time-span tree data generation section generates, on the basis of the second time-span tree data and the common time-span tree data, second intermediate time-span tree data on a second intermediate time-span tree generated by selectively removing one or more pieces of difference information between the second time-span tree and the common time-span tree from the second time-span tree or selectively adding the one or more pieces of difference information to the common time-span tree. The first and second intermediate time-span tree data generation sections may selectively remove or add a single piece of difference information, or two or more pieces of difference information.

The data combining section generates, on the basis of the first intermediate time-span tree data and the second intermediate time-span tree data, combined time-span tree data on a combined time-span tree obtained by combining the first intermediate time-span tree and the second intermediate time-span tree. The musical piece data generation section generates, on the basis of the combined time-span tree data, musical piece data corresponding to the combined time-span tree as musical piece data on the morphed musical piece.

According to the present invention, the first and second intermediate time-span tree data generation sections appropriately selectively remove or add the pieces of difference information, which allows even a user with no special knowledge of music to obtain intermediate musical pieces between the first musical piece and the second musical piece. In the present invention, the first intermediate time-span tree data generation section selectively removing the pieces of difference information from the first time-span tree data means approximating the first intermediate time-span tree from the first time-span tree data to the common time-span tree, that is, reducing the influence of the first musical piece. Conversely, the first intermediate time-span tree data generation section adding the pieces of difference information to the common time-span tree means approximating the first intermediate time-span tree to the first time-span tree data, that is, increasing the influence of the first musical piece. Also, the second intermediate time-span tree data generation section performs the same operation as the first intermediate time-span tree data generation section for the second intermediate time-span tree, that is, the influence of the second musical piece. Thus, changing the number of pieces of difference information to be removed or added changes the proportion between the influence of the first musical piece and the influence of the second musical piece in the morphed musical piece determined on the basis of the combined time-span tree data obtained by combining the first intermediate time-span tree data and the second intermediate time-span tree data. According to the present invention, even a user with little knowledge of music can easily obtain morphed musical pieces in which the proportion between the influence of the first musical piece and the influence of the second musical piece is changed.

Preferably, the first intermediate time-span tree data generation section and the second intermediate time-span tree data generation section include a manual command generation section that generates a command for selectively removing or adding the difference information in response to a manual operation. Although a command can be manually generated, the manual command generation section makes it easy to obtain morphed musical pieces in which the proportion between the influence of the first musical piece and the influence of the second musical piece is changed in accordance with a user's intention.

The manual command generation section may separately generate a command for the first intermediate time-span tree data generation section and a command for the second intermediate time-span tree data generation section. This configuration enhances the degree of freedom in the choice made by the user. Alternatively, the manual command generation section may reciprocally generate a command for the first intermediate time-span tree data generation section and a command for the second intermediate time-span tree data generation section at a time. When the two commands is reciprocally generated at a time, increasing the influence of the first musical piece automatically reduces the influence of the second musical piece, and reducing the influence of the first musical piece automatically increases the influence of the second musical piece. This makes the operation to be performed by the user easier.

It may be determined as desired how the difference information is removed or added. However, preferably, the first intermediate time-span tree data generation section and the second intermediate time-span tree data generation section selectively remove or add the one or more pieces of difference information in accordance with an order of priority determined in advance. If selectively removing or adding the one or more pieces of difference information is performed in accordance with an order of priority determined in advance, the user may recognize the tendency in changes in the obtained morphed musical piece to operate the system appropriately. Preferably, the order of priority is determined on the basis of an importance of a note in the one or more pieces of difference information. The importance of a note is proportional to the intensity of the note. For example, the importance of a note may be determined by utilizing the number of dots calculated on the basis of music theory GTTM. The number of dots indicates the metrical importance of each note, and is suitable for determining the importance of a note. Thus, if the order of priority is determined such that notes of lower importance are removed first, the influence of one of the musical pieces may be gradually reduced. Conversely, if the order of priority is determined such that notes of higher importance are removed first, the influence of one of the musical pieces may be relatively quickly reduced. Also, if the order of priority is determined such that notes of lower importance are added first, the influence of one of the musical pieces can be gradually increased. Conversely, if the order of priority is determined such that notes of higher importance are added first, the influence of one of the musical pieces may be relatively quickly increased.

If the first and second musical pieces are monophonic musical pieces that do not contain a chord, and one branch of the combined time-span tree contains two different notes, the musical piece data generation section may output a plurality of types of musical piece data including a musical piece data in which one of the two notes is selected and a musical piece data in which the other of the two notes is selected, as musical piece data on the morphed musical piece. If one branch of the combined time-span tree contains two different notes, two types of musical piece data individually containing each of the notes are prepared. If a plurality of branches of one combined time-span tree contain two different notes, the number of prepared musical piece data is a power or involution of 2.

Any method may be used to prepare time-span tree data on the first and second musical pieces. The system may further comprise a musical piece database, a musical piece proposed section and a data transfer section. The musical piece database stores in advance the musical piece data and the time-span tree data on a plurality of musical pieces having a relationship that enables generation of the common time-span tree may be prepared. A musical piece proposal section that proposes a plurality of musical pieces that enable generation of a common time-span tree in conjunction with a time-span tree of one musical piece selected from the musical piece database is prepared and the plurality of musical pieces are proposed so as to be selectable. The data transfer section transfers the time-span tree data on the musical piece selected from the plurality of musical pieces proposed by the musical piece proposal section and the time-span tree data on the one musical piece to the common time-span tree data generation section. The use of the musical piece database enables to select a combination of two musical pieces from which a common time-span tree can be inevitably obtained.

The program used to implement the system according to the present invention using a computer causes the computer to implement the common time-span tree data generation section, the first intermediate time-span tree data generation section, the second intermediate time-span tree data generation section, the data combining section, the musical piece data generation section, the manual command generation section, the musical piece proposal section, and the data transfer section. The program may be stored in a computer-readable storage medium.

BEST MODE FOR CARRYING OUT THE INVENTION

Figure 1:
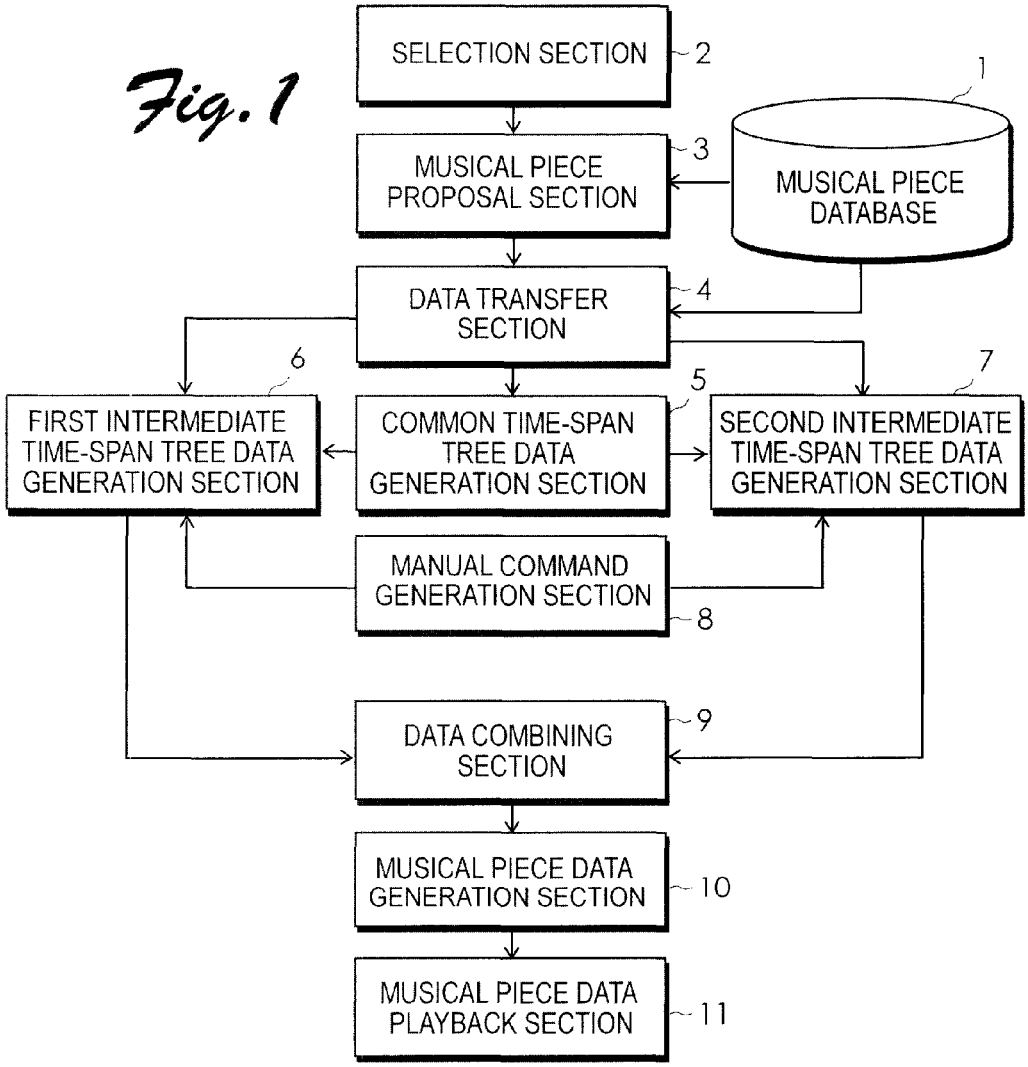
FIG. 1 is a block diagram showing the configuration of a morphed musical piece generation system according to an embodiment of the present invention, implemented by using a computer as a main constituent component.

An embodiment of a morphed musical piece generation system according to the present invention will be described below with reference to the drawings. FIG. 1 is a block diagram showing the configuration of a morphed musical piece generation system according to an embodiment of the present invention, implemented by using a computer as a main constituent component. As shown in FIG. 1, the morphed musical piece generation system includes a musical piece database 1, a selection section 2, a musical piece proposal section 3, a data transfer section 4, a common time-span tree data generation section 5, a first intermediate time-span tree data generation section 6, a second intermediate time-span tree data generation section 7, a manual command generation section 8, a data combining section 9, a musical piece data generation section 10, and a musical piece data playback section 11. Hereinafter, the outline of the configuration of FIG. 1 will be described first, and the details of each block will be described later.

The musical piece database 1 stores in advance musical piece data and time-span tree data on a plurality of musical pieces having a relationship that enables generation of a common time-span tree. The musical piece proposal section 3 proposes a plurality of musical pieces that enable generation of a common time-span tree in conjunction with a time span tree of one musical piece selected by the selection section 2 from the musical piece database 1. The plurality of musical pieces are proposed so as to be selectable. The data transfer section 4 transfers the time-span tree data on the musical piece selected by the selection section 2 from the plurality of musical pieces proposed by the musical piece proposal section 3 and the time-span tree data on the ode musical piece selected in advance to the common time-span tree data generation section 5.

The common time-span tree data generation section 5 generates, on the basis of first time-span tree data on a first time-span tree obtained by analyzing first musical piece data on a first musical piece and second time-span tree data on a second time-span tree obtained by analyzing second musical piece data on a second musical piece, common time-span tree data on a common time-span tree obtained by extracting common information between the first time-span tree and the second time-span tree. The first musical piece data and the second musical piece data have been stored in the musical piece database 1 and transferred from the data transfer section 4.

The first intermediate time-span tree data generation section 6 generates, on the basis of the first time-span tree data and the common time-span tree data, first intermediate time-span tree data on a first intermediate time-span tree generated by selectively removing one or more pieces of difference information between the first time-span tree and the common time-span tree from the first time-span tree or selectively adding the one or more pieces of difference information to the common time-span tree. Likewise, the second intermediate time-span tree data generation section 7 generates, on the basis of the second time-span tree data and the common time-span tree data, second intermediate time-span tree data on a second intermediate time-span tree generated by selectively removing one or more pieces of difference information between the second time-span tree and the common time-span tree from the second time-span tree or selectively adding the one or more pieces of difference information to the common time-span tree. The first and second intermediate time-span tree data generation sections 6 and 7 may selectively remove or add a single piece of difference information, or one or more pieces of difference information.

The first intermediate time-span tree data generation section 6 and the second intermediate time-span tree data generation section 7 include a manual command generation section 8 that generates a command for selectively removing or adding the difference information in response to a manual operation. In this embodiment, the first intermediate time-span tree data generation section 6 and the second intermediate time-span tree data generation section 7 commonly include the manual command generation section 8, and therefore the manual command generation section 8 is conveniently illustrated separated from the first intermediate time-span tree data generation section 6 and the second intermediate time-span tree data generation section 7. The manual command generation section 8 makes it easy to obtain morphed musical pieces in which the proportion between the influence of the first musical piece and the influence of the second musical piece is changed in accordance with a user's intention.

Figure 2A:
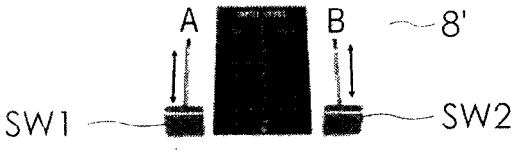
FIG. 2A shows an interface of a manual command generation section that generates separate commands using two switches.
Figure 2B:
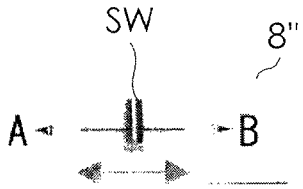
FIG. 2B shows an interface of a manual command generation section that reciprocally generates one of two commands at a time by sliding a single slide switch.

The manual command generation section 8 may separately generate a command for the first intermediate time-span tree data generation section 6 and a command for the second intermediate time-span tree data generation section 7. FIG. 2A shows an interface of a manual command generation section 8' that generates separate commands by using two switches SW1 and SW2. In this interface, the influence of the first musical piece can be adjusted by manipulating the switch SW1 on the A side. Also, the influence of the second musical piece can be adjusted by manipulating the switch SW2 on the B side. Alternatively, the manual command generation section 8 may reciprocally generate one of the command for the first intermediate time-span tree data generation section 6 and the command for the second intermediate time-span tree data generation section 7 at a time. FIG. 2B shows an interface of a manual command generation section 8" that reciprocally generates one of two commands at a time by sliding a single slide switch SW. In this interface, sliding the slide switch SW to the A side increases the influence of the first musical piece while reducing the influence of the second musical piece. Meanwhile, sliding the slide switch SW to the B side increases the influence of the second musical piece while reducing the influence of the first musical piece. This makes the operation to be performed by the user easier.

The data combining section 9 generates, on the basis of the first intermediate time-span tree data and the second intermediate time-span tree data combined time-span tree data on a combined time-span tree obtained by combining the first intermediate time-span tree and the second intermediate time-span tree. The musical piece data generation section 10 generates, on the basis of the combined time-span tree data, musical piece data corresponding to the combined time-span tree as musical piece data on the morphed musical piece. The musical piece data playback section 11 selectively plays the musical piece data on a plurality of morphed musical pieces generated by the musical piece data generation section 10.

In the embodiment, the first and second intermediate time-span tree data generation sections 6 and 7 appropriately selectively remove or add the one or more pieces of difference information, which allows even a user with no special knowledge of music to obtain intermediate musical pieces between the first musical piece and the second musical piece. In the embodiment, the first intermediate time-span tree data generation section 6 selectively removing the one or more pieces of difference information from the first time-span tree data means approximating the first intermediate time-span tree from the first time-span tree data to the common time-span tree, that is, reducing the influence of the first musical piece. Conversely, the first intermediate time-span tree data generation section 6 adding the pieces of difference information to the common time-span tree means approximating the first intermediate time-span tree to the first time-span tree data, that is, increasing the influence of the first musical piece. Also, the second intermediate time-span tree data generation section 7 performs the same operation as the first intermediate time-span tree generation section 6 for the second intermediate time-span tree, that is, the influence of the second musical piece. Thus, changing the number of pieces of difference information to be removed or added changes the proportion between the influence of the first musical piece and the influence of the second musical piece in the morphed musical piece determined on the basis of the combined time-span tree data obtained by combining the first intermediate time-span tree data and the second intermediate time-span tree data. As a result, according to the embodiment, even a user with little knowledge of music can easily obtain morphed musical pieces in which the proportion between the influence of the first musical piece and the influence of the second musical piece is changed.

The operation performed by the blocks in the embodiment of FIG. 1 will be described in further detail below. First, music theory related to a time-span tree to be stored in the musical piece database 1 and automatic analysis of a time-span tree will be described. In the embodiment of the present invention, Generative Theory of Tonal Music (GTTM) [F. Lerdahl and R. Jackendoff, "A Generative Theory of Tonal Music", Cambridge, Mass.: MIT Press, 1983] is used. The music theory GTTM is characterized in comprehensively representing various aspects of music. In order to assist a user with little knowledge of music in appropriately manipulating musical structures, it is necessary to realize consistent manipulations for three aspects of music, namely melody, rhythm, and harmony. For example, when a simple manipulation for splitting a musical piece into two is considered, the manipulation may be implemented differently depending on the musical structure in focus. However, it is desirable that the split position should be essentially the same between an ornamented musical piece and an unornamented musical piece. The GTTM proposes procedures for extracting a time-span tree which discriminates between essential portions and ornamental portions of a melody or a harmony on the basis of a grouping structure which represents separation in a melody of a musical piece and a metrical structure which represents a rhythm and a meter. According to the GTTM, consistent operations can be realized for the three aspects, or melody, rhythm, and harmony.

For implementation of the GTTM on a computer, FATTA (Full-Automatic Time-span Tree Analyzer) has already been developed. FATTA is described in detail in (1) Masatoshi Hamanaka, Keiji Hirata, and Satoshi Tojo, "Implementing 'A Generative Theory of Tonal Music'", Journal of New Music Research, 35:4, pp. 249-277, 2006, (2) Masatoshi Hamanaka, Keiji Hirata, and Satoshi Tojo, "FATTA: Full Automatic Time-span Tree Analyzer", Proceedings of the 2007 International Computer Music Conference, Vol. 1, pp. 153-156, 2007, and (3) Masatoshi Hamanaka, Keiji Hirata, and Satoshi Tojo, "Grouping Structure Generator Based on Music Theory GTTM", Journal of Information Processing Society of Japan, Vol. 48, No. 1, pp. 284-299, 2007. Automatic analysis of a time-span tree based on musical piece data is described in detail in Japanese Unexamined Patent Application Publication No. 2007-191780. Such analysis is also described in detail in a paper titled "Full Automation of Time-span Tree Analyzer" presented by the inventor et al. at SIGMUS 71 in August 2007. The musical piece database 1 stores time-span trees and musical piece data for a plurality of musical pieces generated using such known techniques. The musical piece database 1 according to the embodiment stores in advance musical piece data and time-span tree data on a plurality of musical pieces having a relationship that enables generation of a common time-span tree as discussed earlier. Thus, a morphed musical piece can be inevitably generated from two musical pieces selected from the musical pieces proposed by the musical piece proposal section 3.

Figure 3:
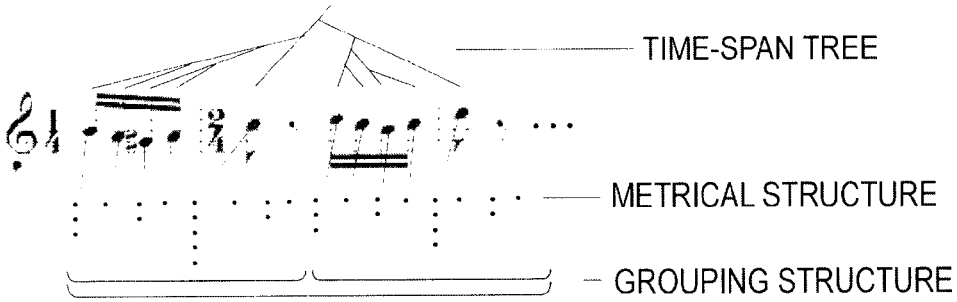
FIG. 3 shows an exemplary relationship between notes and a time-span tree of a musical piece.

In the embodiment, melody morphing is realized using time-span trees obtained as a result of music analysis based on the music theory GTTM. The GTTM is proposed by Fred Lerdahl and Ray Jackendoff as a theory for formally describing intuitions of listeners who have expertise in music. The theory is composed of four sub theories, namely grouping structure analysis, metrical structure analysis, time-span reduction, and prolongation reduction. Various hierarchical structures inherent in a musical score are exposed as deeper structures by analyzing the musical score. Analyzing a musical piece using a time-span tree represents an intuition that abstracting a certain melody trims off ornamental portions of the melody to extract an essential melody. In this analysis, a binary tree (time-span tree) in which a structurally important note of a musical piece (including a musical piece with one or more phrases) becomes a trunk is calculated. FIG. 3 shows an exemplary relationship between notes and a time-span tree of a musical piece. First, the musical piece is divided into hierarchical time spans using the results of grouping structure analysis and metrical structure analysis. Next, each time-span is represented by an important note (called "head") in the time span.

Figure 4:
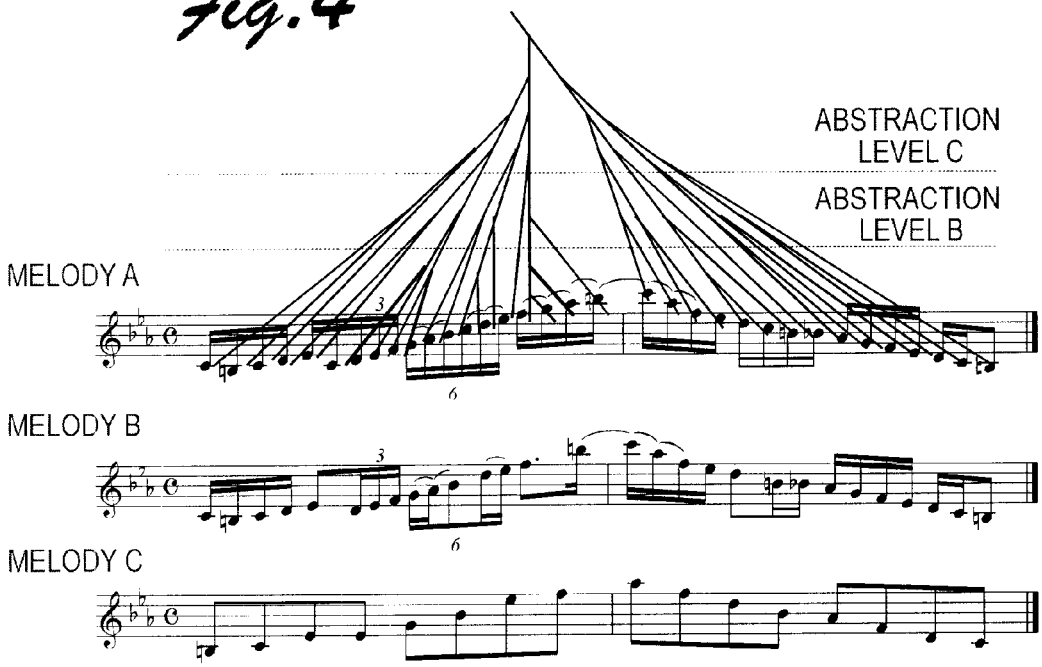
FIG. 4 shows an example of abstracting a musical piece, that is, a melody, using a time-span tree.

FIG. 4 shows an example of abstracting a musical piece, that is, a melody, using a time-span tree. Hereinafter, a musical piece is conveniently referred to as a "melody". In FIG. 4, the time-span tree provided above a melody A is obtained as a result of analyzing the melody A. A melody B is obtained by omitting notes that are connected to branches of the time-span tree under a level B. Further, a melody C is obtained by omitting notes that are connected to branches of the time-span tree under a level C. Such melody abstraction can be considered as a kind of melody morphing, because the melody B is an intermediate melody between the melody A and the melody C. In the embodiment, a time-span tree at a predetermined level in the range from the melody A to the melody C can be used as the time-span tree of a musical piece used in computation.

Next, basic computation techniques used in time-span tree commonization computation performed by the common time-span tree data generation section 5 and time-span tree combining computation performed by the data combining section 9 will be described. The computation techniques used in the embodiment are described in detail in (1) Keiji Hirata and Tatsuya Aoyagi, "Representation Method and Primitive Operations for a Polyphony Based on Music Theory GTTM", Journal of Information Processing Society of Japan, Vol. 43, No. 2, 2002, (2) Keiji Hirata and Yuzuru Hiraga, "Revisiting Music Representation Method based on GTTM", Information Processing Society of Japan SIG Notes, 2002-MUS-45, pp. 1-7, 2002, (3) Keiji Hirata and Satoshi Tojo, "Formalization of Media Design Operations Using Relative Pseudo-Complement", the 19th Annual Conference of the Japanese Society for Artificial Intelligence, 2B3-08, 2005, and (4) Keiji Hirata and Satoshi Tojo, "Lattice for Musical Structure and Its Arithmetics", the 20th Annual Conference of the Japanese Society for Artificial Intelligence, 1D2-4, 2006, and are briefly described herein. In order to realize melody morphing, in the embodiment, computations defined in the papers (1) to (4) mentioned above are utilized. That is, a subsumption relation $\subseteq$, a meet operation $\cap$, and a join operation $\cup$ are used. The subsumption relation $\subseteq$ is represented as F1 $\subseteq$ F2, or F2 subsumes F1, where F1 is a lower structure and F2 is an upper structure (which includes the lower structure and higher structures). For example, the subsumption relation among the time-span trees (or abstracted time-span trees) $T_A$, $T_B$, and $T_C$ of the melodies A, B, and C shown in FIG. 4 can be represented as follows.

$$T_C \subseteq T_B \subseteq T_A$$

Figure 5A:
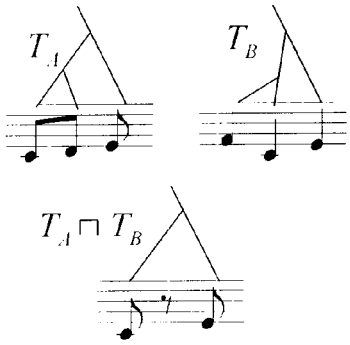
FIG. 5 illustrates a meet operation and a join operation.
Figure 5B:
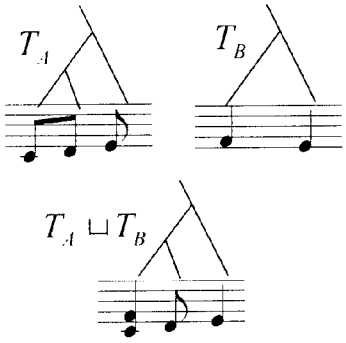

The meet operation calculates a time-span tree $T_A \cap T_B$ of common information between $T_A$ and $T_B$ as shown in FIG. 5A. The join operation calculates a time-span tree $T_A \cup T_B$ by combining the time-span trees $T_A$ and $T_B$ of the melodies A and B as long as no inconsistency is caused as shown in FIG. 5B.

Next, a specific method for melody morphing in the embodiment will be described. In the embodiment, first time-span tree data on a first musical piece, that is, a melody A, and second time-span tree data on a second musical piece, that is, a melody B, are input to the common time-span tree data generation section 5. A command from the manual command generation section 8, which generates a command for removing or adding difference information, in the first and second intermediate time-span tree data generation sections 6 and 7 is changed to change how the respective features of the first and second musical pieces (melodies) are reflected. Then, the data combining section 9 outputs a plurality of combined time-span tree data for generating an intermediate melody C between the melody A and the melody B. In the description below, the melodies A, B, and C meet the following conditions.

1. Melody A and melody C are more similar than melody A and melody B. Also, melody B and melody C are more similar than melody A and melody B.

2. A plurality of melodies C are output by changing how the respective features of A and B are reflected.

3. In the case where melody B is the same as melody A, melody C is also the same as melody A.

4. In the case where melody A and melody B are each a monophony (a melody that does not contain a chord), melody C is also a monophony.

The term "morphing" generally refers to preparing intermediate images, between two given images, that smoothly change from one of the images into the other. In contrast, melody morphing in the embodiment realizes generation of intermediate melodies through the following operations.

Figure 6:
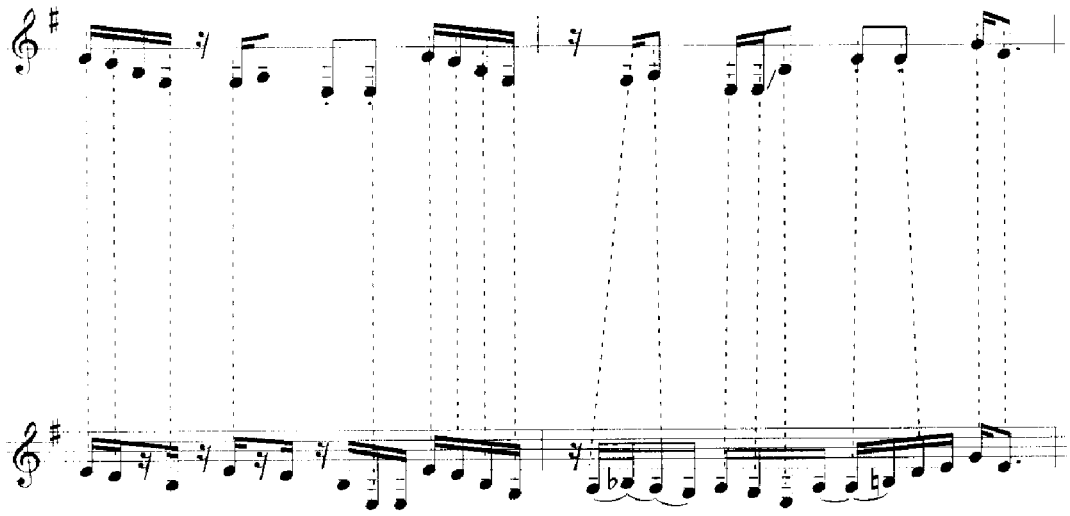
FIG. 6 shows an example of linking melodies.

(a) Linking of Common Information Between Two Melodies (FIG. 6)

(Preparation of Common Time-Span Tree Data)

(b) Melody Divisional Abstraction for Each Melody (Preparation of First and Second Intermediate Time-Span Tree Data)

(c) Combining of the Two Melodies (Combining of First and Second Intermediate Time-Span Tree Data)

First, linking of common information between melodies in (a) described above will be described. Respective time-span trees $T_A$ and $T_B$ of two melodies A and B are calculated, and a time-span tree of common information (meet) between the time-span trees $T_A$ and $T_B$, that is, a common time-span tree $T_A \cap T_B$, is calculated. This allows the time-span trees $T_A$ and $T_B$ to be respectively divided into common information and difference information. In the embodiment, a time-span tree is automatically generated from the melodies using FATTA discussed earlier, that is, a technique for automatically generating a time-span tree. Because FATTA only allows analysis of monophonies, musical pieces used in the embodiment are defined as monophonies.

In order to calculate a common time-span tree $T_A \cap T_B$, the time-span trees $T_A$ and $T_B$ of the melodies A and B are compared from cop to bottom to extract the largest common information. The calculation results may be different between a case where two notes an octave apart (for example, C4 and C3) are regarded as different notes and a case where such octave notes are regarded as the same note. In the case where octave notes are regarded as different notes, C4$\cap$C3 is empty. In the case where octave notes are regarded as the same note, C4$\cap$C3 is C with the octave information abstracted. In the case where the octave information is not defined, processes to be performed by the first and second intermediate time-span tree data generation sections 6 and 7 and subsequent processes are difficult. Thus, in the embodiment, two notes an octave apart are handled as different notes.

Next, melody divisional abstraction in (b) described above performed by the first and second intermediate time-span tree data generation sections 6 and 7 will be described. It is considered that the respective difference information of the time-span trees $T_A$ and $T_B$ of the melodies A and B discussed above contains features that are not contained in the other melody. Thus, in order to realize melody morphing, it is necessary to smoothly increase or decrease the features in the difference information to generate intermediate melodies. Thus, in the embodiment, a process for removing or adding only the difference information between the melodies from or to a time-span tree (herein, such a process is referred to as a "melody divisional abstraction method") is performed. In the melody divisional abstraction method, a melody C that meets the following condition is generated from the time-span tree $T_A$ of the melody A and the common information between the time-span trees of the melodies A and B, that is, the common time-span tree $T_A \cap T_B$.

$$T_A \cap T_B \subseteq T_C \subseteq T_A$$

Figure 7:
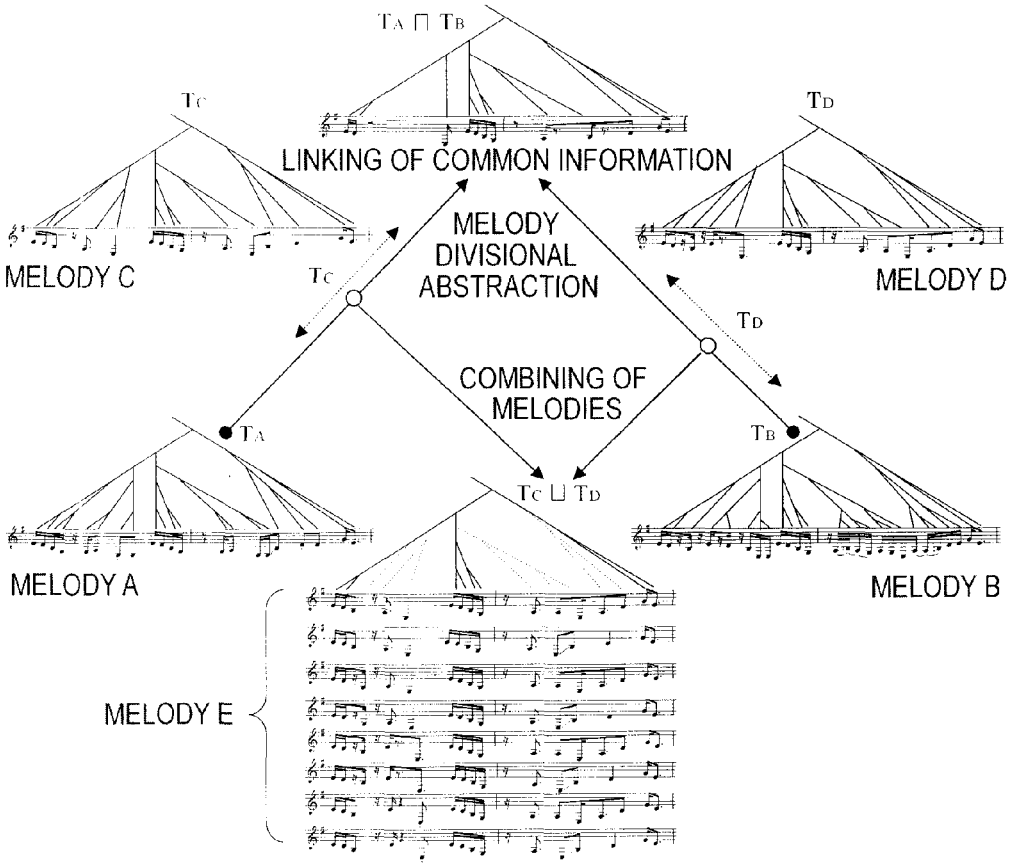
FIG. 7 conceptually shows a process for morphing two melodies.

There are a plurality of intermediate time-span trees $T_C$ that meet the above condition. A subsumption relation is established among all the intermediate time-span trees $T_C$. Thus, in the case where there are C1, C2, . . . , Cn, the following formula is established.

$$T_A \cap T_B \subseteq T_{cn} \subseteq T_{cn-1} \ldots T_{c2} \subseteq T_{c1} \subseteq T_A$$

where $T_A \cap T_B \neq T_{cn}$, $T_{cm} \neq T_{cm-1}$ (m=2, 3, . . . , n), and $T_{c1} \neq T_A$ FIG. 7 conceptually shows a melody morphing process for two melodies A and B that uses the above condition. In the case of FIG. 7, the time-span tree $T_A$ of the melody A contains nine notes that are not contained in the time-span tree $T_B$ of the melody B. Therefore, the value of n is 8, and eight kinds of intermediate melodies of $T_A \cap T_B$ are obtained.

Specifically, the melody divisional abstraction (preparation of intermediate time-span tree data) is performed by following operations by changing a command using the manual command generation section 8.

Step 1: Designation of the Abstraction Level L (Designation of the Number L of Pieces of Difference Information to be Removed or Added)

The user designates the abstraction level L. L is an integer of 1 or more and less than the number of notes that are not contained in the common time-span tree $T_A \cap T_B$ but are contained in the time-span tree $T_A$.

Step 2: Abstraction of the Difference Information (Preparation of Intermediate Time-Span Tree Data)

A head (note) with the smallest number of dots contained in the time span of the difference information between the time-span tree $T_A$ and the common time-span tree $T_A \cap T_B$ is selected to be abstracted (removed). That is, the difference information is removed from the time-span tree $T_A$ such that the note with the smallest number of dots is removed in the highest order of priority. The number of dots is calculated by metrical structure analysis based on the GTTM. In the case where there are a plurality of heads with the smallest number of dots, a head with the smallest number of dots that is closer to the beginning of the musical piece is abstracted.

Step 3: Iteration

Figure 8:
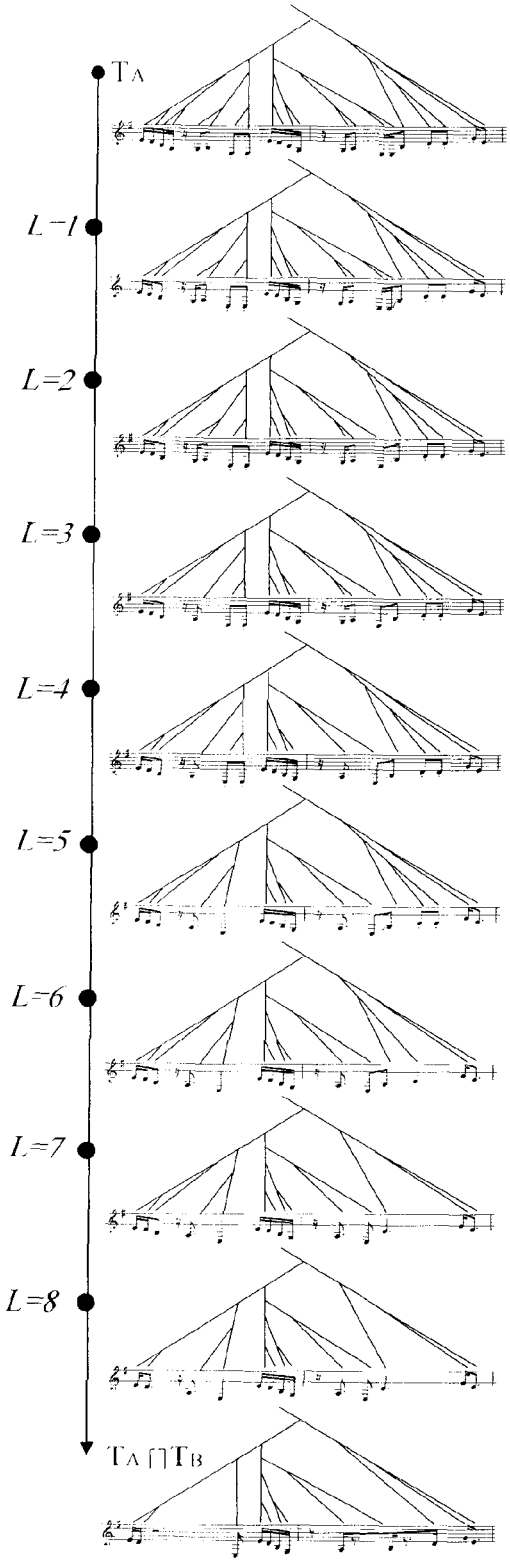
FIG. 8 shows a course of generating intermediate time-span trees.

The operation of step 2 is iterated L times. As seen from FIG. 8, if L is 3, for example, three pieces of difference information are removed from the time-span tree $T_A$ to obtain a first intermediate time-span tree $T_C$ for L=3 (see the melody C and the intermediate time-span tree $T_C$ of FIG. 7).

It is considered that the melody C (intermediate time-span tree $T_C$) calculated as described above is obtained by attenuating some of the features that are possessed only by the melody A (time-span tree $T_A$) and not by the melody B (time-span tree $T_B$).

In the same way as described above, steps 1 to 3 are iterated for the melody B to generate a second intermediate time-span tree $T_D$ of a melody D that meets the following condition from the time-span tree $T_B$ and the common time-span tree $T_A \cap T_B$ (see the intermediate time-span tree $T_D$ of FIG. 7).

$$T_A \cap T_B \subseteq T_D \subseteq T_B$$

The data combining section 9 combines (performs a join operation on) the first intermediate time-span tree $T_C$ of the melody C and the second intermediate time-span tree $T_D$ of the melody D obtained as described above to generate a combined time-span tree of a combined melody E. In order to combine data on the first intermediate time-span tree $T_C$ and the second intermediate time-span tree $T_D$, a join operation shown in FIG. 5B is executed. It should be noted that even if the melodies C and D of the first intermediate time-span tree $T_C$ and the second intermediate time-span tree $T_D$ are monophonies, the melody of the combined time-span tree $T_E = T_C \cup T_D$ is not necessarily a monophony. In other words, in the case where the first intermediate time-span tree $T_C$ and the second intermediate time-span tree $T_D$ with overlapping branches (the matching temporal structure) but with notes at different pitches are to be combined, the solution contains a chord. That is, two notes at different pitches are contained in the same time span. Thus, the data combining section 9 according to the embodiment introduces a special operator that indicates "N1 or N2", for example [N1, N2], where N1 and N2 are the two different notes. That is, the solution of N1∪N2 is [N1, N2]. In this way, the solution of $T_C \cup T_D$ includes a plurality of operators such as [N1, N2]. Then, all the combinations of such values, that is, a plurality of monophonies, are determined as the solution of $T_C \cup T_D$. In FIG. 7, eight melodies are prepared as the melody E. This is because operators such as [N1, N2] are provided at branches of the time-span tree $T_E = T_C \cup T_D$ indicated by broken lines in FIG. 7. That is, two types of melodies, namely one containing N1 and the other containing N2, can be created. Thus, if there are three such operators [N1, N2], $2^3$ morphed musical pieces are prepared.

Figure 9:
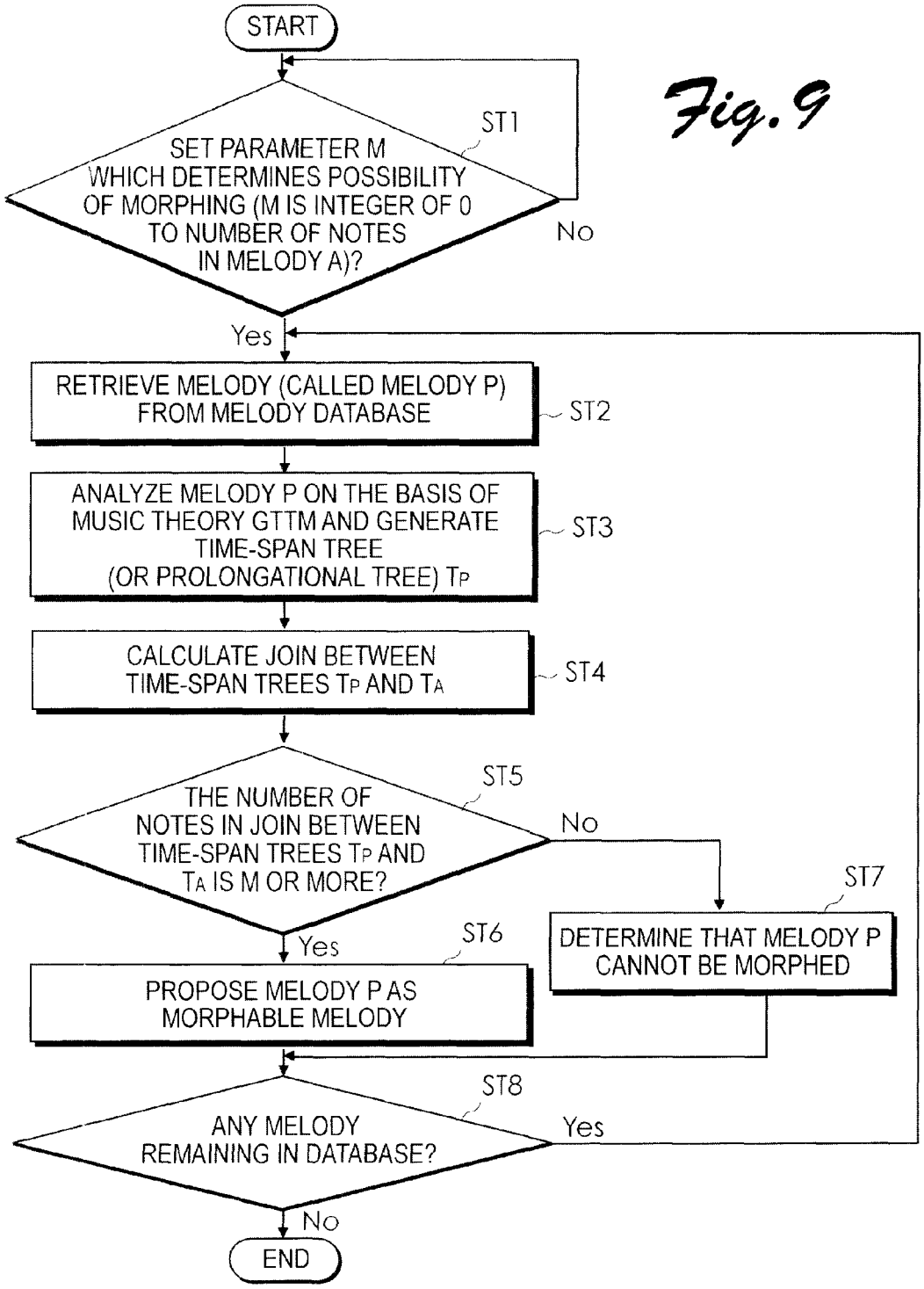
FIG. 9 is a flowchart showing an algorithm of a program used to search musical piece data stored in a musical piece database 1 to find musical pieces that can be morphed with one new musical piece to propose the found musical pieces.

FIG. 9 is a flowchart showing an algorithm of a program used to search musical piece data stored in the musical piece database 1 to find musical pieces that can be morphed with one new musical piece to propose the found musical pieces. In step ST1, it is determined whether or not the value of a parameter M which determines the possibility of morphing is set. The parameter M is an integer of 0 to the number of notes in a melody A. That is, the number of notes in a melody with which morphing can be performed is limited to the number of notes in the melody A or less. Next, in step ST2, a melody is retrieved from the musical piece database 1. This melody is called "P". Next, in step ST3, the melody P is analyzed on the basis of the music theory GTTM to generate a time-span tree (or prolongational tree) $T_P$. Then, in step ST4, a join between the time-span tree $T_P$ and the time-span tree $T_A$ is calculated. If it is determined in step ST5 that the number of notes in the join between the time-span tree $T_P$ and the time-span tree $T_A$ is M or more, the melody P is proposed as a morphable melody in step ST6. If it is determined in step ST5 that the number of notes in the join between the time-span tree $T_P$ and the time-span tree $T_A$ is not M or more, it is determined in step ST7 that the melody P cannot be morphed, and the melody P is not proposed. In step ST8, it is determined whether or not there remains any melody in the musical piece database to propose all the morphable melodies. This algorithm is suitable to find melodies that can be morphed with a new melody.

Figure 10:
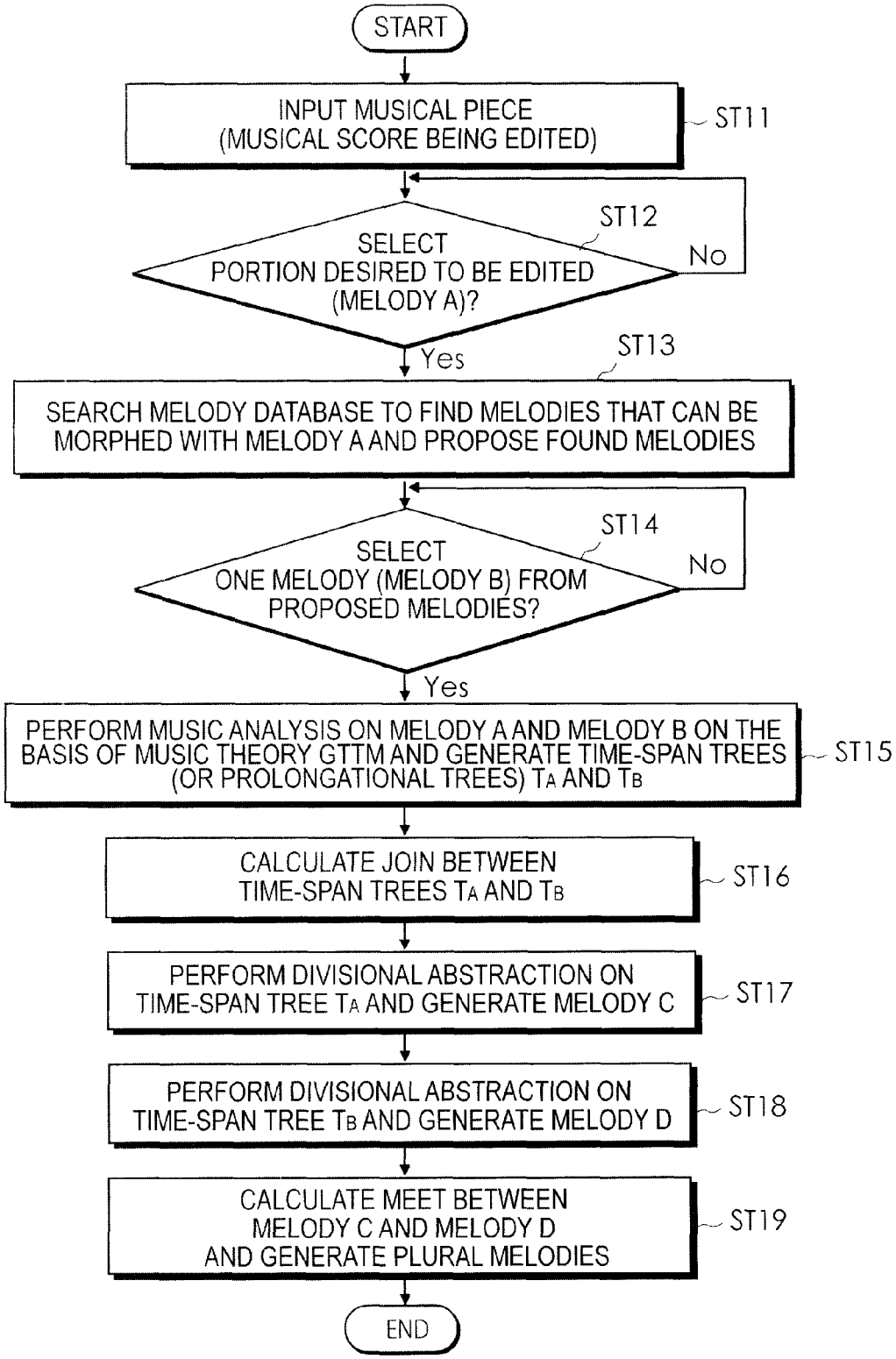
FIG. 10 is a flowchart showing an exemplary algorithm of a program used to implement a main portion of the embodiment of FIG. 1 using a computer, the program being installed on the computer to implement each of the constituent elements discussed earlier in the computer.

FIG. 10 shows an exemplary algorithm of a program used to implement a main portion of the embodiment of FIG. 1 using a computer, the program being installed on the computer to implement each of the constituent elements discussed earlier in the computer. In this example, time-span tree analysis is successively performed on the basis of musical piece data obtained from the musical piece database. In this algorithm, morphing is executed on a musical piece for several bars. First, in step ST11, a musical piece (musical score being edited) is input. Then, in step ST12, it is determined whether or not a portion desired to be edited (melody A) is selected. Then, in step ST13, the musical piece database 1 is searched to find melodies that can be morphed with the melody A to propose the found melodies to the musical piece proposal section 3. Next, in step ST14, it is determined whether or not one melody (melody B) is selected from the proposed melodies. In step ST15, music analysis is performed on the melody A and the melody B on the basis of the music theory GTTM to generate time-span trees (or prolongational trees) $T_A$ and $T_B$. Then, in step ST16, a join (common time-span tree) between $T_A$ and $T_B$ is calculated. That is, a common time-span tree is calculated. Next, in step ST17, divisional abstraction is performed on the time-span tree $T_A$ using the time-span tree $T_A$ and the common time-span tree (difference information is removed from the time-span tree $T_A$ or added) to generate a melody C (first intermediate time-span tree $T_C$). Next, in step ST18, divisional abstraction is performed on the time-span tree $T_B$ using the time-span tree $T_B$ and the common time-span tree (difference information is removed from the time-span tree $T_B$ or added) to generate a melody D (second intermediate time-span tree $T_D$). Finally, in step ST19, a meet $T_C \cup T_D$ between the first intermediate time-span tree of the melody C and the second intermediate time-span tree of the melody D is calculated. Consequently, a combined time-span tree $T_E$ is obtained to obtain a plurality of morphed musical pieces.

Figure 11:
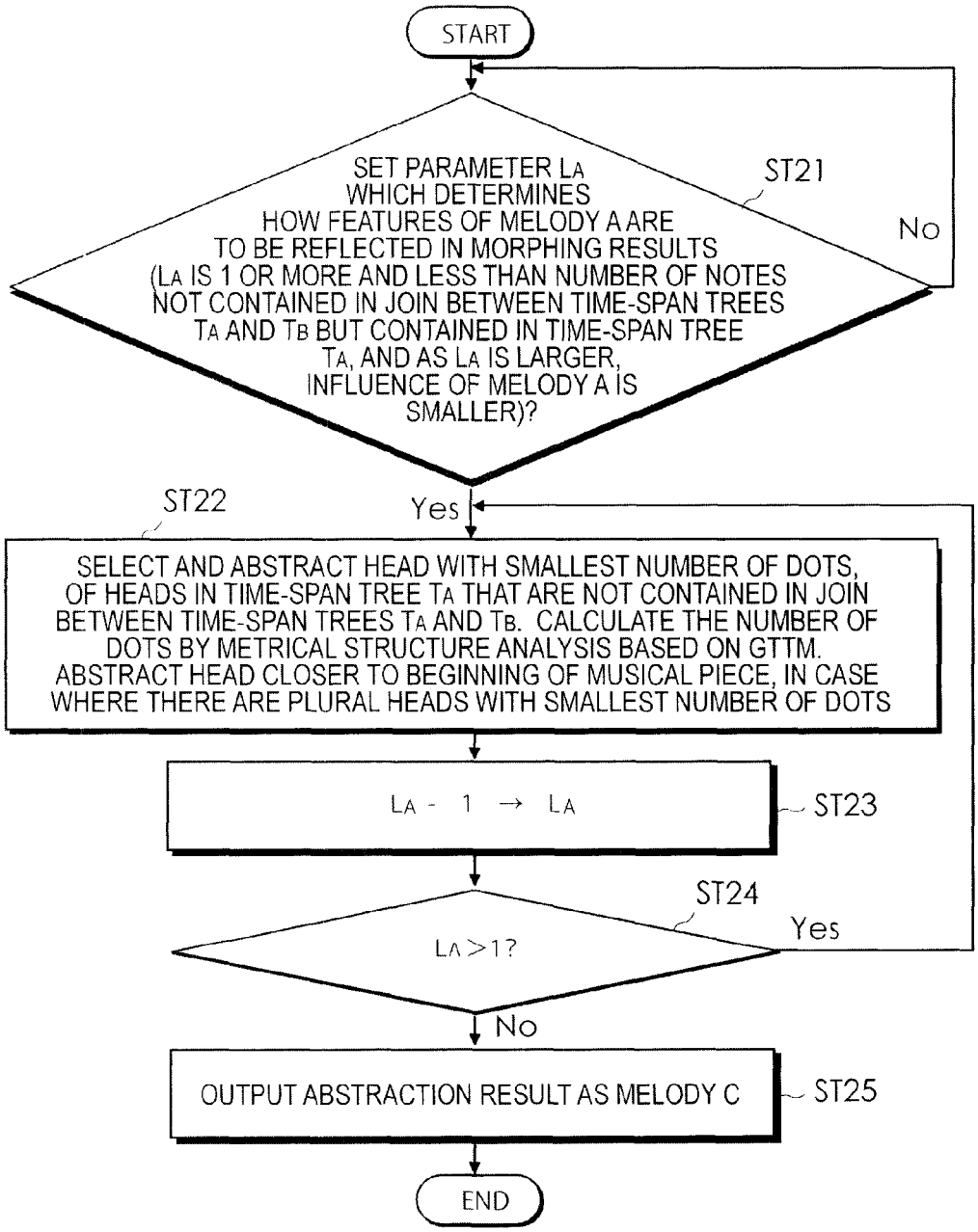
FIG. 11 is a flowchart showing the details of step ST17 of FIG. 10.

FIG. 11 shows the details of step ST17. That is, in step ST21, it is checked whether or not a parameter $L_A$ which determines extent that the features of the melody A are to be reflected in the morphing results is set. That is, it is checked in step ST21 whether or not the number (command) of pieces of difference information to be removed or added to prepare a first intermediate time-span tree is set. Specifically, it is determined whether or not $L_A$ is a number of 1 or more and less than the number of notes (number of pieces of difference information) that are not contained in the join (common time-span tree) between $T_A$ and $T_B$ but are contained in the first time-span tree $T_A$. In the case where the difference information is removed from the time-span tree, the influence of the melody A is smaller as the value of the parameter $L_A$ is larger. Next, in step ST22, of a plurality of heads in the first time-span tree $T_A$ that are not contained in the join between $T_A$ and $T_B$, a head with the smallest number of dots, which serves as an index of the importance of each note, is selected to be abstracted (removed). The number of dots is calculated by metrical structure analysis based on the GTTM. In the case where there are a plurality of heads with the smallest number of dots, a head with the smallest number of dots that is closer to the beginning of the musical piece is abstracted (removed in the highest order of priority). Then, after $L_A$ pieces of difference information are removed in steps ST23 and ST24, the resulting time-span tree is determined as the first intermediate time-span tree in step ST25. That is, the abstraction result is output as the time-span tree of a melody C.

Figure 12:
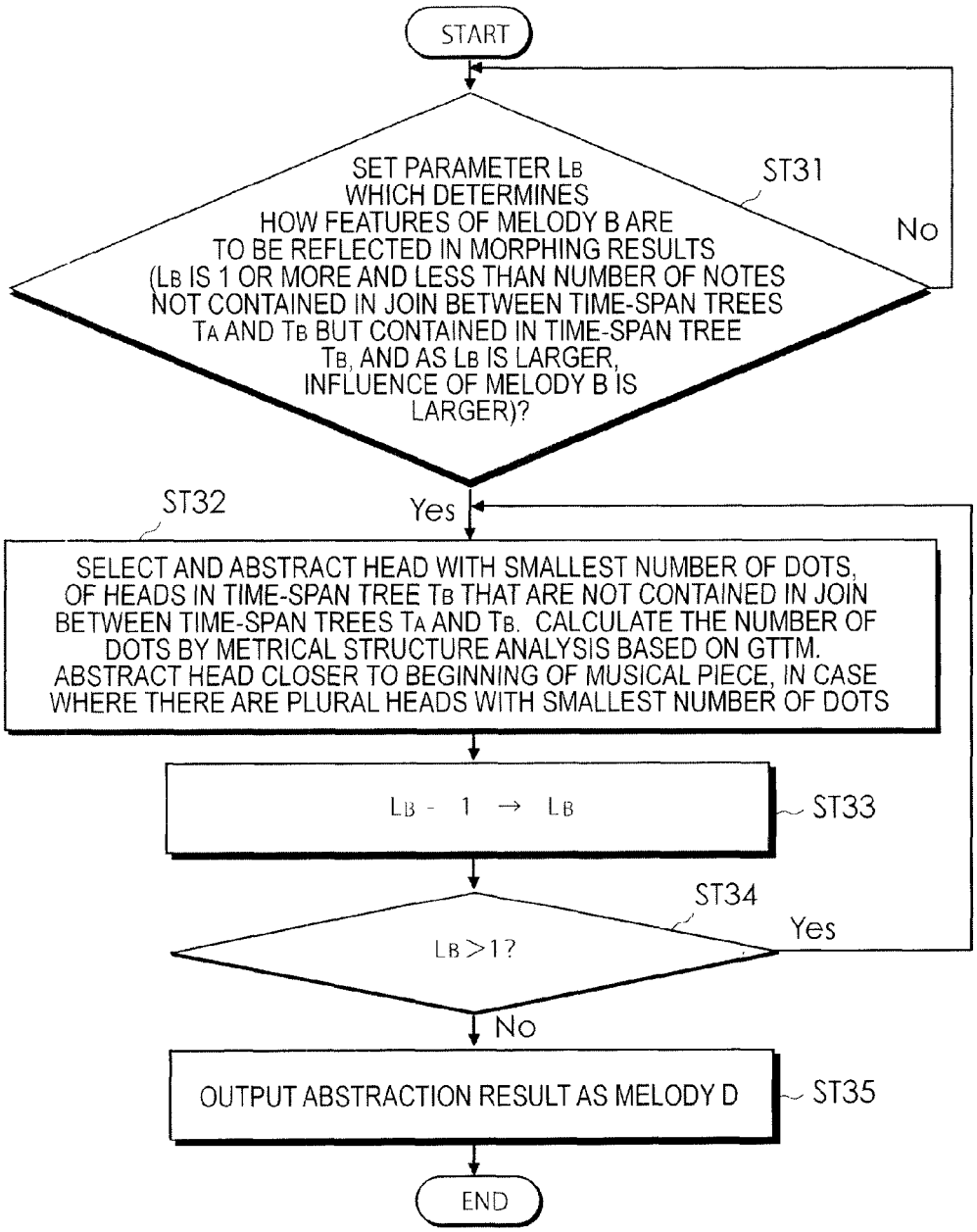
FIG. 12 is a flowchart showing the details of step ST18 of FIG. 10.

FIG. 12 shows the details of step ST18 of FIG. 10. Steps ST31 to ST35 are the same as steps ST21 to ST25 of FIG. 11 except that the second time-span tree $T_B$ is treated and that a parameter $L_B$ which determines how the features of the melody B are to be reflected in the morphing results is set, and thus are not described herein.

According to the embodiment, morphing between musical pieces or melodies can be performed while reflecting a user's intention. When musical piece data on a melody A and musical piece data on a melody B are input, the morphed musical piece generation system according to the embodiment outputs an intermediate melody C between the melody A and the melody B. Such a system makes it relatively easy to understand the causal relationship between inputs and outputs of the system. Therefore, a plurality of melodies can be obtained by simple operations for selecting two melodies A and B and changing the ratio between A and B, which makes it relatively easy to reflect a user's intention. In other words, in the case where a user desires to correct a part of a melody A to add some nuance to the melody A, the system makes it possible to search for a melody B with such a nuance and add the nuance of the melody B to the melody A by morphing.

While only monophonies are allowed as inputs in the embodiment, the present invention is also applicable to a case where polyphonies containing a chord are used as inputs.

INDUSTRIAL APPLICABILITY

According to the present invention, it is easy for even a user with little knowledge of music to obtain morphed musical pieces in which the proportion between the influence of a first musical piece and the influence of a second musical piece is changed.

What is claimed is:

1. A morphed musical piece generation system that generates a morphed musical piece between a first musical piece and a second musical piece, comprising:

a common time-span tree data generation section that generates, on the basis of first time-span tree data on a first time-span tree obtained by analyzing first musical piece data on the first musical piece and second time-span tree data on a second time-span tree obtained by analyzing second musical piece data on the second musical piece, common time-span tree data on a common time-span tree obtained by extracting common information between the first time-span tree and the second time-span tree;

a first intermediate time-span tree data generation section that generates, on the basis of the first time-span tree data and the common time-span tree data, first intermediate time-span tree data on a first intermediate time-span tree generated by selectively removing one or more pieces of difference information between the first time-span tree and the common time-span tree from the first time-span tree or selectively adding the one or more pieces of difference information to the common time-span tree;

a second intermediate time-span tree data generation section that generates, on the basis of the second time-span tree data and the common time-span tree data, second intermediate time-span tree data on a second intermediate time-span tree generated by selectively removing one or more pieces of difference information between the second time-span tree and the common time-span tree from the second time-span tree or selectively adding the one or more pieces of difference information to the common time-span tree;

a data combining section that generates, on the basis of the first intermediate time-span tree data and the second intermediate time-span tree data, combined time-span tree data on a combined time-span tree obtained by combining the first intermediate time-span tree and the second intermediate time-span tree; and a musical piece data generation section that generates, on the basis of the combined time-span tree data, musical piece data corresponding to the combined time-span tree as musical piece data on the morphed musical piece.

2. The morphed musical piece generation system according to claim 1, wherein the first intermediate time-span tree data generation section and the second intermediate time-span tree data generation section include a manual command generation section that generates a command for selectively removing or adding the one or more pieces of difference information in response to a manual operation.

3. The morphed musical piece generation system according to claim 2, wherein the manual command generation section separately generates the command for the first intermediate time-span tree data generation section and the command for the second intermediate time-span tree data generation section.

4. The morphed musical piece generation system according to claim 2, wherein the manual command generation section reciprocally generates one of the command for the first intermediate time-span tree data generation section and the command for the second intermediate time-span tree data generation section at a time.

5. The morphed musical piece generation system according to claim 1, wherein the first intermediate time-span tree data generation section and the second intermediate time-span tree data generation section selectively remove or add the one or more pieces of difference information in accordance with an order of priority determined in advance.

6. The morphed musical piece generation system according to claim 5, wherein the order of priority is determined on the basis of an importance of a note in the one or more pieces of difference information.

7. The morphed musical piece generation system according to claim 1, wherein if the first and second musical pieces are monophonic musical pieces that do not contain a chord and the combined time-span tree contains two different notes in an identical time span, the musical piece data generation section is constructed so as to output a plurality of types of musical piece data including a musical piece data in which one of the two notes is selected and a musical piece data in which the other of the two notes is selected as musical piece data on the morphed musical piece.

8. The morphed musical piece generation system according to claim 1, further comprising:

a musical piece database that stores in advance the musical piece data and the time-span tree data on a plurality of musical pieces having a relationship that enables generation of the common time-span tree;

a musical piece proposal section that proposes a plurality of musical pieces that enable generation of a common time-span tree in conjunction with a time-span tree of one musical piece selected from the musical piece database, the plurality of musical pieces being proposed so as to be selectable; and a data transfer section that transfers the time-span tree data on the musical piece selected from the plurality of musical pieces proposed by the musical piece proposal section and the time-span tree data on the one musical piece to the common time-span tree data generation section.

9. A morphed musical piece generation program executable by a computer to generate a morphed musical piece between a first musical piece and a second musical piece, the program causing the computer to implement:

a common time-span tree data generation section that generates, on the basis of first time-span tree data on a first time-span tree obtained by analyzing first musical piece data on the first musical piece and second time-span tree data on a second time-span tree obtained by analyzing second musical piece data on the second musical piece, common time-span tree data on a common time-span tree obtained by extracting common information between the first time-span tree and the second time-span tree;

a first intermediate time-span tree data generation section that generates, on the basis of the first time-span tree data and the common time-span tree data, first intermediate time-span tree data on a first intermediate time-span tree generated by selectively removing one or more pieces of difference information between the first time-span tree and the common time-span tree from the first time-span tree or selectively adding the one or more pieces of difference information to the common time-span tree;

a second intermediate time-span tree data generation section that generates, on the basis of the second time-span tree data and the common time-span tree data, second intermediate time-span tree data on a second intermediate time-span tree generated by selectively removing one or more pieces of difference information between the second time-span tree and the common time-span tree from the second time-span tree or selectively adding the one or more pieces of difference information to the common time-span tree;

a data combining section that generates, on the basis of the first intermediate time-span tree data and the second intermediate time-span tree data, combined time-span tree data on a combined time-span tree obtained by combining the first intermediate time-span tree and the second intermediate time-span tree; and a musical piece data generation section that generates, on the basis of the combined time-span tree data, musical piece data corresponding to the combined time-span tree as musical piece data on the morphed musical piece.

10. The morphed musical piece generation program according to claim 9, the first intermediate time-span tree data generation section and the second intermediate time-span tree data generation section include a manual command generation section that generates a command for selectively removing or adding the difference information in response to a manual operation.

11. The morphed musical piece generation program according to claim 10, wherein the manual command generation section separately generates the command for the first intermediate time-span tree data generation section and the command for the second intermediate time-span tree data generation section.

12. The morphed musical piece generation program according to claim 9, wherein the manual command generation section reciprocally generates one of the command for the first intermediate time-span tree data generation section and the command for the second intermediate time-span tree data generation section at a time.

13. The morphed musical piece generation program according to claim 9, wherein the first intermediate time-span tree data generation section and the second intermediate time-span tree data generation section selectively remove or add the one or more pieces of difference information in accordance with an order of priority determined in advance.

14. The morphed musical piece generation program according to claim 13, wherein the order of priority is determined on the basis of an importance of a note in the one or more pieces of difference information.

15. The morphed musical piece generation program according to claim 9, wherein if the first and second musical pieces are monophonic musical pieces that do not contain a chord and the combined time-span tree contains two different notes in an identical time span, the musical piece data generation section is constructed so as to output a plurality of types of musical piece data including a musical piece data in which one of the two notes is selected and a musical piece data in which the other of the two notes is selected as musical piece data on the morphed musical piece.

16. The morphed musical piece generation program according to claim 9, causing the computer to further implement:

a musical piece proposal section that proposes a plurality of musical pieces that enable generation of a common time-span tree in conjunction with a time-span tree of one musical piece selected from a musical piece database, the musical piece database storing in advance the musical piece data and the time-span tree data on a plurality of musical pieces having a relationship that enables generation of the common time-span tree, the plurality of musical pieces being proposed so as to be selectable; and a data transfer section that transfers the time-span tree data on the musical piece selected from the plurality of musical pieces proposed by the musical piece proposal section and the time-span tree data on the one musical piece to the common time-span tree data generation section.

17. A storage medium that stores the program according to claim 9 in a computer-readable manner.

18. A storage medium that stores the program according to claim 10 in a computer-readable manner.

19. A storage medium that stores the program according to claim 11 in a computer-readable manner.

20. A storage medium that stores the program according to claim 12 in a computer-readable manner.

* * * * *